United States Patent [19]

Koopmans et al.

[11] Patent Number: 4,657,306

[45] Date of Patent: Apr. 14, 1987

[54] HYDRAULIC ROCK BREAKING TOOL

[76] Inventors: Robert Koopmans, R.R. #2, Acton, Ontario, Canada, L7J 2L8; Robin W. Hughes, 65 Waterford Drive, TH 805, Weston, Ontario, Canada, M9R 2N7

[21] Appl. No.: 790,234

[22] Filed: Oct. 18, 1985

[51] Int. Cl.[4] ..... E21C 37/10

[52] U.S. Cl. ..... 299/21; 29/113 R

[58] Field of Search ..... 299/20, 21; 166/308, 166/187, 212; 29/113 R

[56] References Cited

U.S. PATENT DOCUMENTS

| | | | |
|---|---|---|---|
| 1,630,470 | 5/1927 | Clifford | 299/21 |
| 1,863,286 | 6/1932 | Sheppard | 299/21 |
| 1,915,687 | 6/1933 | Meyer | 299/21 |

*Primary Examiner*—Stephen J. Novosad

*Assistant Examiner*—Michael A. Goodwin

*Attorney, Agent, or Firm*—Ridout & Maybee

[57] ABSTRACT

A hydraulic rock breaking tool of modular construction comprises an assembly of shaft sections having a longitudinally extending bore therethrough and lateral passages communicating with the bore. The shaft assembly provides a number of radial abutment flanges between which a number of self-supporting, radially expansible, elastomeric membranes are confined in the longitudinal direction, each membrane having a cylindrical portion surrounding the shaft and defining with it an annular space communicating with the bore via the lateral passages. Each membrane has a pair of annular end flanges, each terminating in an axially extending retrorse flange which is seated against the shaft section for sealing engagement with it, the retrorse flanges being urged against the shaft by fluid pressure in the annular space.

7 Claims, 2 Drawing Figures

HYDRAULIC ROCK BREAKING TOOL

Figure 1:
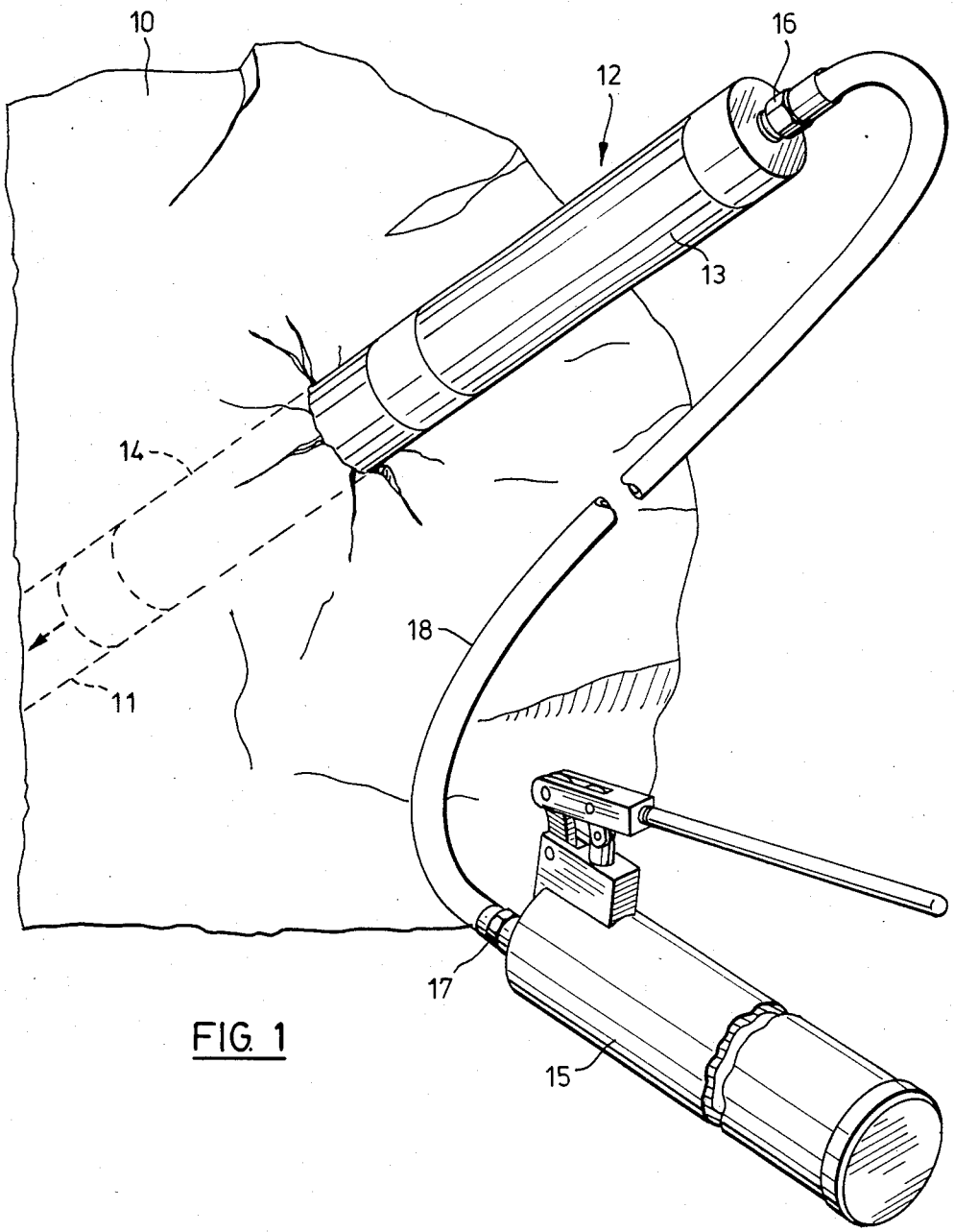

This invention relates to hydraulic rock breaking tools. Such tools are intended to be used in conjunction with a rock drill for breaking boulders, concrete and ore masses into smaller pieces.

It is a known practice, for the purpose of disintegrating a boulder or like mass, to drill a hole into the boulder and then to insert a tool which can be expanded by internal hydraulic pressure. Such tools, herein referred to as hydraulic rock breaking tools, are disclosed for example in U.S. Pat. Nos. 1,630,470, 1,808,162, 1,863,286, 1,915,687 and 2,211,243.

A hydraulic rock breaking tool of the type referred to typically comprises a rigid metal shaft having a longitudinally extending bore therethrough and lateral passages communicating with the bore, which has a coupling means at one end for connection to a pressurized hydraulic supply. A radially expansible membrane surrounding the shaft defines with the shaft an annular space into which pressurized fluid is introduced via the lateral passages, thereby expanding the membrane. The ends of the membrane are clamped firmly to the shaft by special clamping members so as to close the ends of the annular space.

The present invention provides a hydraulic rock breaking tool in which the expansible membrane is of such a configuration as to seal against the shaft when it is internally pressurized, without the requirement of special clamping means as are required by the known rock breaking tools. The construction is simpler and less costly than the known tools, and easily permits replacement of a damaged membrane when used in the field. In a preferred form of the invention, the tool is of modular construction such that the modular sections can readily be interchanged.

According to one aspect of the present invention, a hydraulic rock breaking tool comprises a rigid metal shaft having a longitudinally extending bore therethrough and lateral passages communicating with the bore, coupling means at one end of the shaft for connecting the bore to a pressurized hydraulic fluid supply, and a self-supporting, radially expansible, elastomeric membrane surrounding the shaft. The membrane has a cylindrical portion defining with the shaft an annular space communicating with the bore via said lateral passages, and radially inwardly directed end flanges which abut against longitudinally spaced radial abutments on the shaft, these flanges terminating in axially extending retrorse flanges seated against the shaft for sealing engagement therewith and being urged against the shaft by fluid pressure in said annular space.

According to another aspect of the present invention, a hydraulic rock breaking tool comprises: a rigid metal shaft assembly having a longitudinally extending bore therethrough and lateral passages communicating with the bore, the shaft assembly comprising a plurality of modular shaft sections interconnected end to end; coupling means at one end of the shaft assembly for connecting the bore to a pressurized hydraulic fluid supply; an end cap at the other end of the shaft closing the bore, the end cap providing a first radial abutment flange; each shaft section providing at its end remote from the end cap a second radial abutment flange; a plurality of self-supporting, radially expansible, elastomeric membranes surrounding the shaft sections, each membrane providing a cylindrical portion extending between a respective pair of the radial abutment flanges and defining with the respective shaft section an annular space communicating with the bore via the lateral passages; each membrane providing a pair of radially inwardly directed flanges at the ends of its cylindrical portion, which flanges abut against the pair of radial abutment flanges; and the radially inwardly directed flanges terminating in axially extending retrorse flanges seated against the shaft section for sealing engagement therewith, the retrorse flanges being urged against the shaft by fluid pressure in the annular space.

Figure 2:
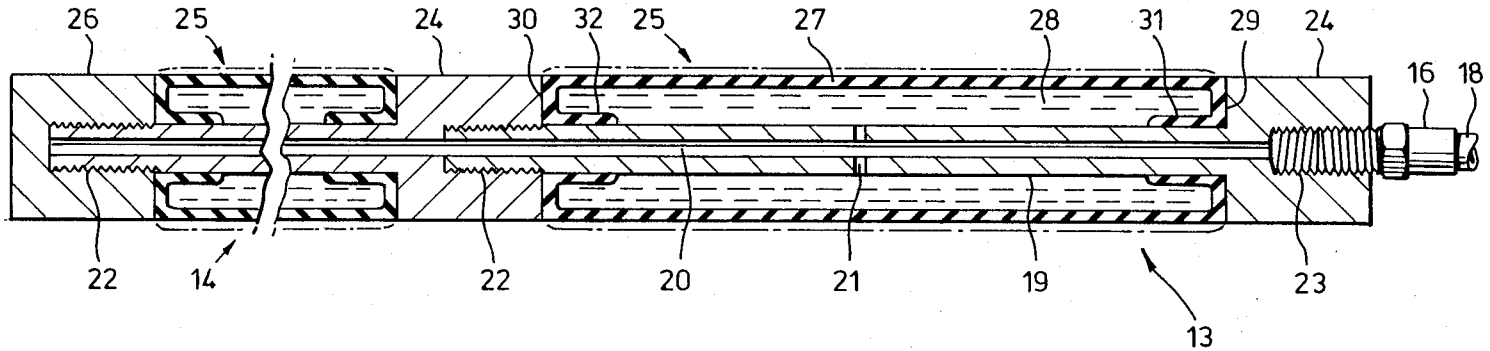

One preferred embodiment of the invention will now be described, by way of example, with reference to the accompanying drawings in which:

FIG. 1 is a perspective view of an apparatus incorporating a rock breaking tool in accordance with the invention, the figure showing the manner in which the tool is used; and FIG. 2 is a partly broken, longitudinal sectional elevation of a rock breaking tool according to the invention, the tool being of modular construction and comprising at least two modules.

Referring to FIG. 1, 10 denotes a mass of rock, concrete or ore which has to be broken into smaller pieces. In accordance with the established practice a cylindrical bore 11 is first drilled into the mass to a chosen depth. The rock breaking tool 12 is inserted into the bore, the tool comprising a plurality of interchangeable hydraulic cartridges, or modules 13, 14, (two being shown in the drawing) the number of modules being chosen to suit the depth of the bore 11 in any case. In certain cases, in which the depth of the bore is not substantially greater than the modular length, the tool will be employed with just a single hydraulic cartridge.

In the illustrated embodiment, in which a plurality of hydraulic cartridges are employed, the cartridges are rigidly interconnected end to end, and are supplied with pressurized hydraulic fluid from a hydraulic jack 15 by way of fluid couplings 16, 17 and a hose 18. Each hydraulic cartridge consists essentially of a rigid metal mandrel portion on which is mounted a self-supporting, radially expansible, elastomeric membrane. The mandrel provides a longitudinally extending shaft 19 having a longitudinally extending bore 20 therethrough, and lateral passages 21 communicating with the bore 20. The shaft 19 is formed at one end with an externally threaded spigot 22, and at its other end with an internally threaded socket 23 for engagement with the spigot 22 of a like cartridge. The said other end of the shaft 19 is stepped to form a cylindrical end portion 24 of greater diameter so as to provide a radial abutment flange. Each elastomeric membrane 25 is confined longitudinally between the radial abutment flanges 24 of adjacent modules, except that one end radial abutment flange is provided by an end cap 26. This end cap 26 engages the externally threaded spigot 22 of the end module so as to close that end of the bore 20. The other end of the bore is connected to the hose 18 by a fluid coupling 16 which engages the socket 23 of the first cartridge remote from the end cap 26.

Each elastomeric membrane 25 has a longitudinally extending cylindrical portion 27 which surrounds the shaft 19 of the mandrel on which it is mounted so as to define therewith an annular space 28 communicating with the bore 20 via the lateral passages 21. The membrane 27 necessarily has some flexibility, but it has sufficient rigidity to maintain its form and to be self-supporting on the mandrel shaft 19. For this purpose the membrane is of an elastomeric material, preferably a polyurethane composition. One particularly suitable material is a durable but flexible adiprene, which is a mixture of polyurethane and hardener.

At the ends of the cylindrical membrane portion 27 are a pair of radially inwardly directed annular flanges 29, 30 which abut, respectively, against the opposed faces of adjacent radial abutment flanges 24. The outside diameters of the membranes 25 are substantially the same as those of the abutment flanges 24 and the end cap 26, so that the tool is of substantially the same diameter throughout its length.

The radially inwardly directed flanges 29, 30 terminate at their inner ends in axially extending retrorse flanges 31, 32, these axial flanges being turned in towards one another. The flanges 31, 32 are seated against the mandrel shaft for sealing engagement therewith, and the membrane configuration is such that these flanges are urged into tighter sealing engagement with the shaft 19 as the fluid pressure in the space 28 is increased to expand the membrane.

A most important feature of the tool construction is that, should a membrane break, it can be easily and economically replaced. The shaft itself does not have to be replaced along with the membrane as in other rock breaking tool constructions. Another important feature of the system is that the length of contact of the tool in a bore hole can be increased by simply adding modules. Each time another module is added, the contact length is increased by the modular length, a suitable modular length being seven inches. The modules are easily interconnected by means of the spigot and socket couplings so as to form a rigid mandrel or shaft assembly, and to provide a high strength interface between individual membranes. Thus, the need to use membranes of different lengths for bore holes of different depths is eliminated.

Membrane replacement is both simple and inexpensive. If one membrane should break, it can be replaced with another standard membrane simply by unscrewing the assembly just below the broken membrane. The detachable end cap 26 allows quick removal of air in the system when filling the system with oil. The system is designed to operate at pressures up to 10,000 p.s.i., which affords a high safety factor since most rocks will fracture below 5,000 p.s.i.

What we claim is:

1. A hydraulic rock breaking tool comprising:

a rigid metal shaft assembly having a longitudinally extending bore therethrough and lateral passages communicating with said bore, the shaft assembly comprising a plurality of modular shaft sections interconnected end to end;

coupling means at one end of the shaft assembly for connecting said bore to a pressurized hydraulic fluid supply;

an end cap at the other end of the shaft assembly closing the bore, the end cap providing a first radial abutment flange;

each shaft section providing at its end remote from said end cap a second radial abutment flange;

a plurality of self-supporting, radially expansible, elastomeric membranes surrounding the shaft sections, each membrane providing a cylindrical portion extending between a respective pair of said radial abutment flanges and defining with the respective shaft section an annular space communicating with said bore via said lateral passages, each said membrane providing a pair of radially inwardly directed flanges at the ends of its cylindrical portion, which flanges abut against the pair of radial abutment flanges; and said radially inwardly directed flanges terminating in axially extending retrorse flanges seated against the shaft section for sealing engagement therewith, said retrorse flanges being urged against the shaft by fluid pressure in said annular space.

2. A hydraulic rock breaking tool according to claim 1, wherein the first and second radial abutment flanges are cylindrical, each providing a pair of annular faces, each membrane being confined in the longitudinal direction between the opposed annular faces of adjacent abutment flanges.

3. A hydraulic rock breaking tool according to claim 2, wherein the first and second radial abutment flanges and the membranes are of substantially the same diameter.

4. A hydraulic rock breaking tool according to claim 1, wherein the membranes are of adiprene.

5. For a hydraulic rock breaking tool as claimed in claim 1, a hydraulic cartridge comprising a rigid metal shaft having a longitudinally extending bore therethrough and lateral passages communicating with said bore, the shaft providing a cylindrical flange adjacent one end thereof, said one end of the shaft providing a coupling socket communicating with the bore and the other end of the shaft providing a spigot adapted to be coupled to the socket of a like cartridge, and a self-supporting, radially expansible, elastomeric membrane surrounding the shaft and having a cylindrical portion defining with the shaft an annular space communicating with the bore via said lateral passages, said cylindrical portion having radially inwardly directed end flanges each terminating in an axially extending retrorse flange seated against the shaft for sealing engagement therewith, the radial abutment flange providing a first annular abutment face to abut against one end flange of said membrane, and a second, opposed, annular abutment face engageable with the other end flange of an adjacent membrane.

6. A hydraulic rock breaking tool comprising:

a rigid metal shaft having a longitudinally extending bore therethrough and lateral passages communicating with the bore;

coupling means at one end of the shaft for connecting said bore to a pressurized hydraulic fluid supply;

a self-supporting, radially expansible, elastomeric membrane surrounding the shaft and having a cylindrical portion defining with the shaft an annular space communicating with the bore via said lateral passages;

longitudinally spaced radial abutment means on said shaft, said radial abutment means being constituted by cylindrical flanges of the same diameter as the membrane and providing a pair of longitudinally spaced opposed abutment faces confining the membrane in the longitudinal direction;

said membrane providing radially inwardly directed flanges at the ends of said cylindrical portion, which flanges abut against said abutment means, said radially inwardly directed flanges terminating in axially extending retrorse flanges seated against the shaft for sealing engagement therewith and urged against the shaft by fluid pressure in said annular space.

7. A hydraulic rock breaking tool according to claim 6, wherein the membrane is of adiprene.

* * * * *